US006789704B2

(12) United States Patent
Hennessey et al.

(10) Patent No.: US 6,789,704 B2
(45) Date of Patent: Sep. 14, 2004

(54) CONTAINER FOR LIQUID COSMETIC PRODUCT

(76) Inventors: Colleen Hennessey, 57 Doolittle Rd., Stamford, CT (US) 06902; Katherine M. Powers, 122 Old Orchard La., Ochard Park, NY (US) 14127

( * ) Notice: Subject to any disclaimer, the term of this patent is extended or adjusted under 35 U.S.C. 154(b) by 0 days.

(21) Appl. No.: 10/366,907

(22) Filed: Feb. 19, 2003

(65) Prior Publication Data

US 2004/0159673 A1 Aug. 19, 2004

(51) Int. Cl.[7] ..... B65D 35/56

(52) U.S. Cl. ..... 222/105; 222/158; 222/206; 222/215

(58) Field of Search ..... 222/92, 105, 107, 222/158, 206, 211, 212, 215

(56) References Cited

U.S. PATENT DOCUMENTS 3,101,086 A * 8/1963 Vito ..... 401/183
4,147,278 A * 4/1979 Uhlig ..... 222/95
4,209,027 A * 6/1980 Morganroth ..... 401/281
4,473,097 A * 9/1984 Knickerbocker et al. ... 222/158
5,067,501 A * 11/1991 Auger ..... 222/158
5,289,833 A * 3/1994 McDonald ..... 132/112
5,924,605 A * 7/1999 Baudin et al. ..... 222/212
6,035,806 A * 3/2000 Lorenzo ..... 119/603
6,109,487 A * 8/2000 Hashimoto ..... 222/109
6,332,726 B2 * 12/2001 Yamamoto et al. ..... 401/183
6,467,653 B1 * 10/2002 Hamamoto et al. ..... 222/105
6,581,803 B1 * 6/2003 Yoshimoto et al. ..... 222/105

FOREIGN PATENT DOCUMENTS

EP 1153845 A1 * 11/2001 ..... B65D/77/04

* cited by examiner

*Primary Examiner*—Kenneth Bomberg
(74) *Attorney, Agent, or Firm*—Philip M. French, Esq.

(57) ABSTRACT

This invention relates to a container suitable for preparing and dispensing a liquid cosmetic product, particularly a product for dyeing or bleaching hair.

20 Claims, 3 Drawing Sheets

CONTAINER FOR LIQUID COSMETIC PRODUCT

FIELD OF THE INVENTION

The present invention relates to containers and, more particularly, to a container for the preparation and/or dispensing of liquid cosmetic hair products.

BACKGROUND OF THE INVENTION

Typical cosmetic hair treatments involve preparing and applying a liquid color composition to hair. Hair color compositions ordinarily include a hair coloring ingredient which is carefully admixed in precise proportion with a developing agent. The developing agent and hair coloring ingredient then interact before being applied to the hair to be treated.

Hair color applications done by a salon professional involve formulas in which a hair coloring ingredient and a developing agent, usually hydrogen peroxide, must be admixed accurately to ensure a good hair color result. After they have been allowed to interact for a predetermined time period, the cosmetic product may be transferred to an appropriate dispenser for application to the hair being treated.

Many of the ingredients of cosmetic products, especially hair coloring compositions, are quite expensive. It is therefore desirable to utilize a mixing container in which precise amounts of the ingredients may be measured as they are combined. This avoids mistakes in their admixture and the necessity of adding an additional amount of one or more of the ingredients to effect the desired product formula. It allows the salon professional to mix less product per application and thereby avoid waste of expensive ingredients.

In dispensing or applying a cosmetic product such as a hair coloring composition, it is often important to ensure that the composition is applied in a manner which results in the desired effect. This may require careful placement of sometimes disproportionate amounts of composition. This is true, for example, whether one is streaking uniformly colored hair or attempting to make non-uniformly colored hair more uniform in appearance. As a result, it is important to carefully control where and how much cosmetic product is applied to the hair.

After application of the cosmetic product, the dispenser or the dispensing and mixing containers must normally be carefully cleaned to ensure that they are free of residue which might contaminate any subsequent cosmetic product placed in them. It is important in admixing dyes or tints to avoid unpleasant surprises to the hair being treated, particularly where a container which held a very dark dye is reused with a very light tint.

SUMMARY OF THE INVENTION

An object of the present invention is to create a container which allows the measured preparation of a cosmetic product, particularly a coloring composition for dyeing or bleaching hair.

Another object of the present invention is to create a container which will function as a dispenser of cosmetic product and allow careful control over where and how much of a cosmetic product, especially a coloring composition, is dispensed while treating hair.

Another object of the present invention is to create a container which is partially disposable. It is desired that at least most of the portion of the container which comes in contact with cosmetic product is replaceable, in order to facilitate the reuse of the container with different cosmetic products.

Still further objects of the present invention are the creation of a single container which can fulfil both of the foregoing functions and which will not require the careful and complete cleaning between uses which has normally been necessary.

In accordance with the present invention, there is provided a container for liquid cosmetic product including a housing composed of flexible sidewall means having an elongate central cavity, with the sidewall means having an opening at the anterior end of the housing. Disposed within the central cavity is a collapsible bag having an opening situated proximate to the anterior end of the housing. A cap is detachably affixed to the anterior end of the housing. The cap is adapted to hold the collapsible bag within the housing and has an aperture communicating with the bag opening.

The sidewall means of the housing are normally thin and may be composed of plastic or other flexible material. The container may have any number of sidewall means forming any elongate three-dimensional shape. However, it is preferred to utilize only one sidewall means, curved to provide a tubular housing.

By "flexible" according to the present invention, what is meant is that the housing sidewall means are relatively rigid and yet are deformable while under external pressure, such as squeezing, while rebounding to an undeformed shape when such pressure is relaxed. Because this flexibility effects the shape of the housing, it may also reduce the volume of its central cavity. Consequently, the application of external pressure on the container housing may be communicated by contact to the bag disposed within its central cavity.

The bag within the housing is collapsible. By "collapsible" according to the present invention, what is meant is that the bag and/or its walls are non-resilient and incapable of maintaining any particular shape, absent a supporting force. Like the housing, it may be composed of plastic, but usually its walls are much thinner in thickness.

A cosmetic product may be prepared by mixing its ingredients in the collapsible bag. Exertion of pressure on the housing causes it to flex radially inward, forcing the cosmetic product from the collapsing bag, through the cap aperture, for application to the hair being treated.

Relaxation of pressure controls this application. The housing rebounds to its original configuration. As the housing separates from the bag, the flow of product is reduced. Once the application of cosmetic product has been completed, the bag may be removed from the container and discarded. A new bag may be placed within the housing and the container is then ready for reuse.

In a preferred form of the present invention, the bag extends through the opening at the anterior end of the housing. The bag may have a circumferential lip which extends outwardly from the bag at the bag opening. It is especially desirable that the anterior end of the housing sidewall means forms a substantially circular edge. A similarly shaped lip may be pressed against the edge at the anterior end of the housing to ensure the optimal positioning of the bag within the central cavity of the housing.

In combination with the foregoing preferred embodiments of the present invention, it is desirable that the cap hold the bag in place by pressing the lip against the edge at the anterior end of the housing. One means by which this may be accomplished involves a cap comprising a substantially circular top and having a skirt disposed substantially perpendicularly from the perimeter of the top. The skirt may extend posteriorly of the edge of the anterior end of the housing. The skirt and anterior end of the housing may bear ridges, such as screw threads, adapted to detachably affix the cap to the housing. By screwing or otherwise locking the cap and housing temporarily together, the bag lip located between these elements is held firmly within the housing.

In a still further preferred embodiment of the present invention, a hollow or tubular dispensing member extends outwardly from, and communicates with, the cap aperture. This dispensing member may, for example, have a frustoconical or other elongate shape in order to allow its penetration into a head of hair for application of hair coloring composition from its tip, directly to the hair roots.

The dispensing member and the associated cap aperture may be situated together anywhere on the cap. The dispensing member may extend radially or, more desirably, anteriorly from the cap. Most desirably, it is located acentric to the cap top. This enhances the ability to precisely direct application of the coloring composition to the desired location in the hair. This location also facilitates dispensing all the composition from the bag.

As previously described, there must be an opening at the anterior end of the housing. The sidewall means of the housing may similarly terminate at its posterior end, leaving a second opening through which the enclosed bag is exposed to the atmosphere. In this embodiment, the edge of the posterior end, like that at the opposite or anterior end of the housing, is desirably substantially circular. Thus, it may lie in a plane essentially perpendicular to the axis along which the container is elongated.

Alternatively, the posterior end of the housing may be sealed, thereby enclosing the bag. In this preferred embodiment, there may be a base spanning the sidewall means. Again, the plane of the base is desirably essentially perpendicular to the axis along which the container is elongated. Such a base provides a secure seating means for the container when it is not in use.

This alternative embodiment is also preferred because it has been discovered that such a base affords greater control over the dispensing of cosmetic product. Sealing off the posterior end of the housing from the atmosphere does not substantially effect the dispensing of cosmetic product while pressure is being applied to the housing sidewall means. However, when pressure is relaxed and the housing rebounds to an undeformed shape, air is drawn in through the dispensing means and/or cap aperture. This immediately reverses the flow of cosmetic product being dispensed. Consequently, it ensures against accidental over treatment of portions of hair.

In another preferred embodiment of the present invention, both the uncollapsed bag and the housing are substantially cylindrical in shape. Further, they are essentially contiguous or similarly sized so that the uncollapsed bag fits snugly within the central cavity of the housing.

Especially when these elements of the present invention have this preferred configuration, it is desirable that the sidewall means and bag are each composed of translucent or, even more desirably, transparent material. In this embodiment, the housing may bear graduated markings. Such markings may be adapted to measure the volume of liquid cosmetic product within the uncollapsed bag. This enhances the ability to precisely combine the amounts of hair coloring composition ingredients necessary for any given formula.

Other features and advantages of the present invention will become readily apparent from the following detailed description, appended drawings and accompanying Claims.

BRIEF DESCRIPTION OF THE DRAWINGS

For a better understanding of this invention, a nonlimiting embodiment thereof will now be described with reference to the attached drawings wherein.

DETAILED DESCRIPTION OF PREFERRED EMBODIMENTS

Figure 1:
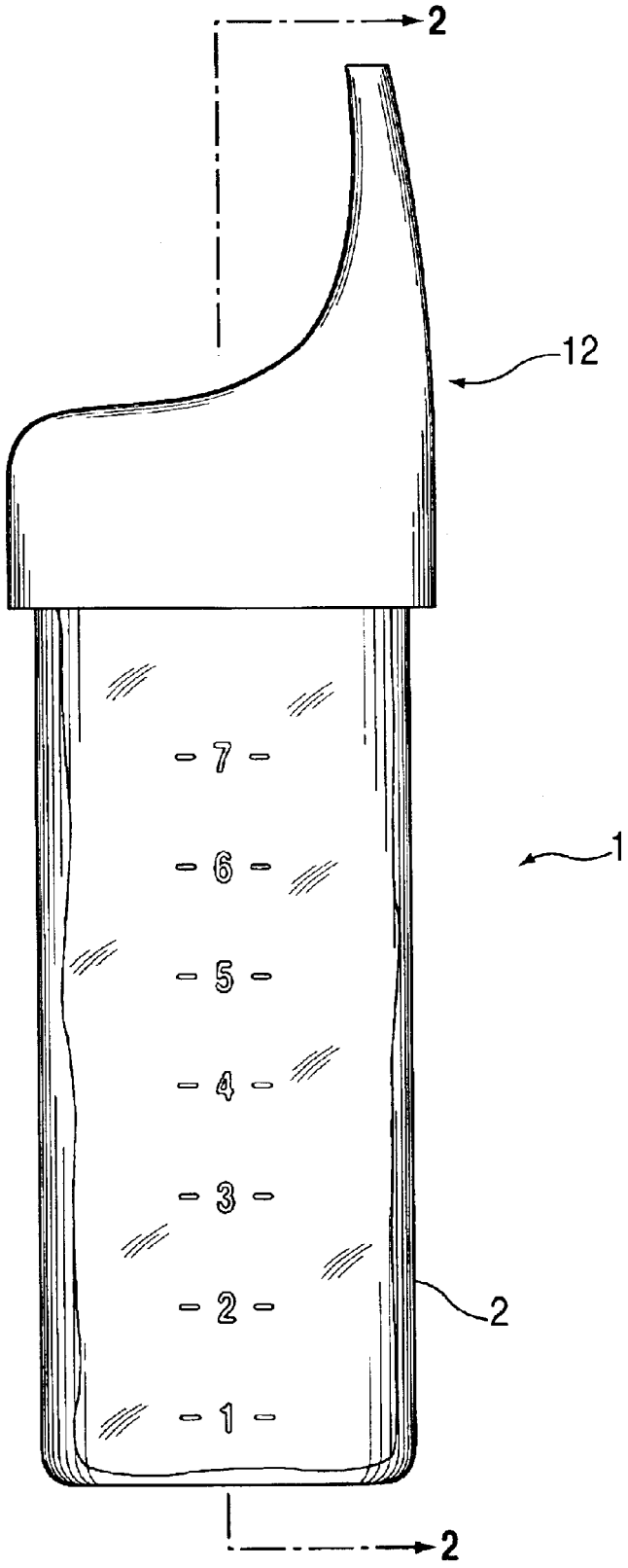
FIG. 1 depicts an assembled embodiment of the present invention.

The container 1 of the present invention shown in the exterior view of FIG. 1 has an elongate cylindrical housing 2 made of transparent plastic, for example polyethylene or polypropylene. Detachably affixed to the anterior end of the housing is the cap 12. The cap is adapted to hold the collapsible bag (not shown) in the proper position within the housing 2.

Figure 2:
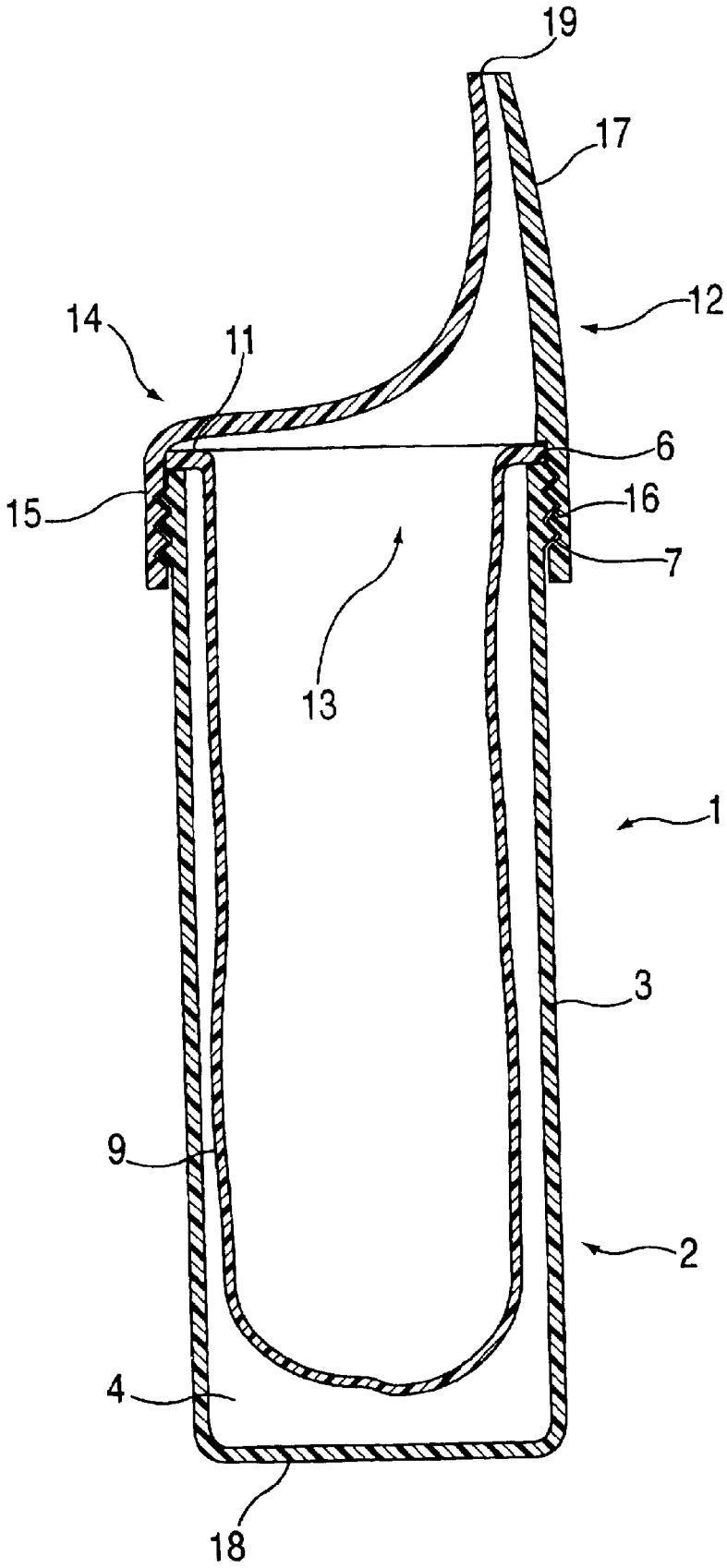
FIG. 2 is a lengthwise cross-section through the container embodiment of FIG. 1 along line 2—2.

As shown in the cross-sectional view of FIG. 2, the container 1 is composed of the flexible housing 2, the collapsible bag 9 and the cap 12. Each is shown in its normal or unpressured orientation.

The collapsible bag 9 comprises the main receptacle for mixing and/or holding the liquid cosmetic product (not shown). It is depicted as being a thin liner which is essentially contiguous with the housing sidewall means 3. The bag has a circumferential lip 11 which extends radially outwardly from the bag opening.

The housing 2 is composed of sidewall means 3, here depicted as being tubular in shape. A base 18, formed by molding the sidewall material across these means, seals the posterior end of the container. An elongate central cavity 4, largely occupied by the previously described bag 9, is enclosed within the sidewall means and this base. In this embodiment, the bag lip 11 is shown resting within the housing opening defined by the edge 6 at the anterior end of the sidewall means 3.

The housing sidewall means 3 are thin so as to flex radially inward upon exertion of pressure such as occurs when squeezed in the operator's hand. Under such pressure, the volumes of the elongated central cavity 4 and the bag 9 disposed within it are correspondingly reduced. This forces the liquid cosmetic product (not shown) within the bag 9 out the bag and through the cap 12.

The cap 12 is here shown as being composed of a substantially circular top 14, having a skirt 15 disposed substantially perpendicularly from its perimeter and extending posteriorly of the anterior edge 6 of the housing.

The cap 12 is shown as being detachably affixed to the housing 2 by means of ridges 7 and 16, correspondingly located on the contiguous surfaces of the housing sidewall means 3 and cap skirt 15. These ridges 7 and 16 allow the cap 12 and housing 2 to be screwed snugly together. Moreover, as shown in this embodiment, the bag lip 11 lies between the anterior housing edge 6 and the cap top 14. Consequently this same action also holds the bag 9 firmly in its appropriate position.

Also shown in this embodiment is an optional dispensing member 17. A hollow conduit running the length of tubular dispensing member 17 communicates with the cap aperture 13 and extends to cap tip 19. Consequently, liquid cosmetic product forced out of the bag 9 by pressure on the housing sidewall means 3 passes through the length of this hollow member and may be precisely dispensed from tip 19 to the desired location on an individuals hair.

Figure 3:
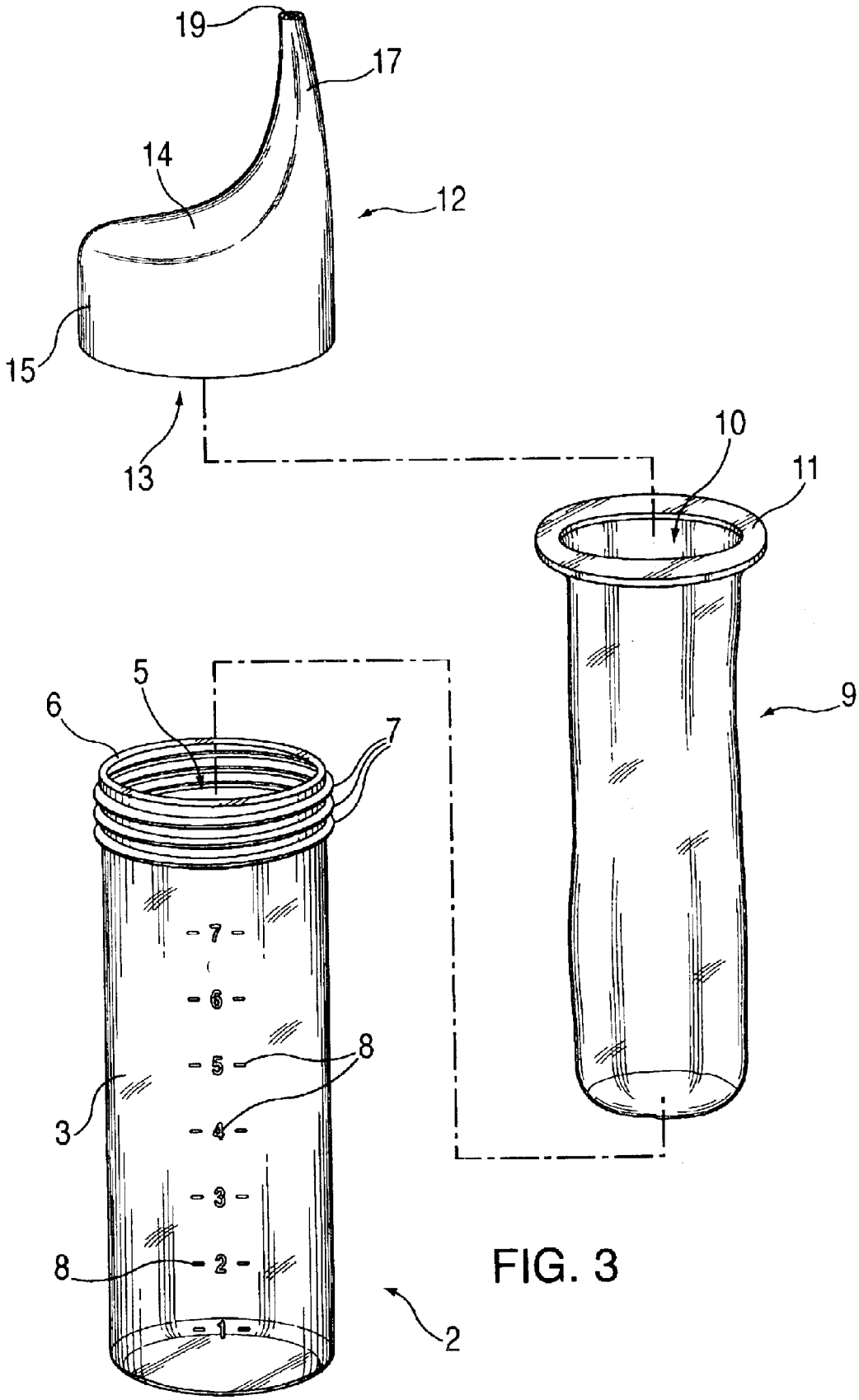
FIG. 3 is an exploded elevation view of the container embodiment of FIG. 1.

As shown in the exploded view of FIG. 3, each of the three essential elements of this invention—the housing 2, the bag 9 and the cap 12—are easily separable from the others. This facilitates disposal and substitution of a new bag for reuse with the remaining elements whenever a new cosmetic product is to be mixed and/or dispensed.

The disposable bag 9 is shown in the normal, expanded shape it would exhibit if filled with liquid cosmetic product (not shown). This is largely the same shape as that of the tubular sidewall means 3 of the housing 2. At the opening 10 of the bag 9, there is depicted the circumferential lip 11 which extends radically outwardly and, in conjunction with the cap 12 and anterior housing edge 6, allows the bag to be held in appropriate position within the container.

The housing 2 is here shown to be composed of an essentially tubular sidewall means 3. At the anterior end of the sidewall means are shown ridges 7 for affixing the housing to the cap 12 as well as the substantially circular edge 6, surrounding the housing opening 5, upon which the bag lip 11 may rest.

Also depicted on the housing 2 are graduated markings 8. They are adapted to measure the volume(s) of liquid ingredients added to the bag 9 within the housing. Such markings facilitate the correct and precise admixture of the appropriate ingredients of any particular cosmetic product.

The cap 12 is shown as comprising a skirt 15, adapted to extend over the anterior end of the housing 2 for afixture thereto, and cap top 14 having a dispensing member 17 extending therefrom. The cap aperture (not shown) communicates with the bag opening 10 and the dispensing member to permit application of cosmetic product to the hair from the tip 19 of that member.

It is to be understood that the provided illustrative examples are by no means exhaustive of the many possible uses of the invention. From the foregoing description, one skilled in the art can easily ascertain the essential characteristics of this invention and, without departing from the spirt and scope thereof, can make various changes and modifications of the invention to adapt it to various usages and conditions. For example, the artisan could construct the present container other suitable geometric shapes. It is to be understood therefore that the present invention is not limited to the sole embodiment described above, but encompasses any and all embodiments within the scope of the following claims.

What is claimed is:

1. A container for dispensing a liquid cosmetic product comprising:

a housing having flexible sidewall means around an elongate central cavity, said sidewall means having an opening at the anterior end of the housing;

a collapsible bag for holding said product, said bag being disposed within said central cavity and having an opening situated proximate to said anterior end of the housing;

a cap detachably affixed to said anterior end of the housing, said cap being adapted to hold said bag within said housing and having an aperture communicating with the bag opening; and a base spanning said sidewall means, sealing said housing to enclose said bag. Whereby a flow of said product being dispensed reverses when pressure applied to said sidewall means is relaxed and said housing rebounds to an undeformed shape.

2. The container of claim 1, wherein the bag extends through the opening at the anterior end of the housing.

3. The container of claim 2, wherein a circumferential lip extends radially outwardly from the bag at the bag opening.

4. The container of claim 3, wherein the anterior end of the housing sidewall means forms a substantially circular edge.

5. The container of claim 4, wherein the cap holds the bag by pressing the lip against the edge at the anterior end of the housing.

6. The container of claim 1, wherein the cap comprises a substantially circular top having a skirt disposed substantially posteriorly from the perimeter of said top.

7. The container of claim 6, wherein the skirt extends posteriorly of the edge of the anterior end of the housing.

8. The container of claim 7, wherein the skirt and anterior end of the housing bear ridges adapted to detachably affix the cap and housing.

9. The container of claim 1, wherein a hollow dispensing member extends outwardly from the cap and communicates with the cap aperture.

10. The container of claim 9, wherein the aperture and dispensing member are acentric to the cap top.

11. The container of claim 10, wherein the sidewall means and bag are each composed of translucent material.

12. The container of claim 11, wherein the housing sidewall means bears graduated markings adapted to measure the volume of liquid within the uncollapsed bag.

13. The container of claim 12, wherein the uncollapsed bag and housing sidewall means are substantially cylindrical.

14. The container of claim 13, wherein the housing sidewall means is adapted to flex upon exertion of pressure and rebound upon relaxation of said pressure.

15. In a method for the treatment of hair with multiple liquid cosmetic compositions, the improvement which comprises:

Dispensing a first liquid cosmetic composition onto hair from the bag of a container comprising:

a housing having flexible sidewall means around an elongate central cavity, said sidewall means having an opening at the anterior end of the housing;

a collapsible bag disposed within said central cavity and having an opening situated proximate to said anterior end of the housing; and a cap detachably affixed to said anterior end of the housing, said cap being adapted to hold said bag within said housing and having an aperture communicating with the bag opening;

Removing and disposing of said bag;

Inserting a second bag into said container;

Adding the ingredients of a second liquid cosmetic composition to said second bag;

Mixing said ingredients within said second bag to form said second liquid cosmetic composition; and Dispensing said second liquid cosmetic product onto hair.

16. The method of claim 15, wherein the housing sidewall means is adapted to flex upon exertion of pressure and rebound upon relaxation of said pressure.

17. The method of claim 16, wherein a base spans the sidewall means. sealing the posterior end of the housing to enclosed the bag.

18. The method of claim 17, wherein the bag extends through the opening at the anterior end of the housing.

19. The method of claim 18, wherein the housing siewall means is adapted to flex upon exertion of pressure and rebound upon relaxation of said pressure.

20. The method of claim 19, wherein a hollow dispensing member extends outwardly from the cap and communicates with the cap aperture.

* * * * *